United States Patent [19]

Wakatsuki

[11] Patent Number: 4,518,381

[45] Date of Patent: May 21, 1985

[54] SHEET FOLDING MACHINE

[75] Inventor: Susumu Wakatsuki, Kanagawa, Japan

[73] Assignee: Fuji Xerox Co., Ltd., Japan

[21] Appl. No.: 543,806

[22] Filed: Oct. 24, 1983

Related U.S. Application Data

[63] Continuation of Ser. No. 305,318, Sep. 24, 1981, abandoned.

[30] Foreign Application Priority Data

Oct. 1, 1980 [JP] Japan ..... 55-135785

[51] Int. Cl.[3] ..... B65H 45/18

[52] U.S. Cl. ..... 493/444; 493/445

[58] Field of Search ..... 493/444, 445

[56] References Cited

U.S. PATENT DOCUMENTS

| | | | |
|---|---|---|---|
| 216,599 | 6/1879 | Chambers | 493/444 X |
| 2,470,754 | 5/1949 | Abler | 493/444 X |
| 3,630,514 | 12/1971 | Del Vecchie | 493/444 X |
| 3,632,104 | 1/1972 | Dufour | 493/444 |
| 4,419,088 | 12/1983 | Nemec | 493/444 |

FOREIGN PATENT DOCUMENTS

| | | | |
|---|---|---|---|
| 2258697 | 6/1974 | Fed. Rep. of Germany | 493/444 |

*Primary Examiner*—A. J. Heinz

*Attorney, Agent, or Firm*—Sughrue, Mion, Zinn, Macpeak, and Seas

[57] ABSTRACT

A sheet folding machine having a pair of sheet folding rollers and a widthwise displacing direction sheet stopper provided in a sheet conveying path. The pair of sheet folding rollers are rotatable perpendicular to the sheet conveying direction of the sheet conveying path and abut against each other with the sheet stopper disposed along the sheet conveying direction. An idle roller adapted to depress a sheet against one of said sheet folding rollers. A curving member bends the sheet towards the nipping region of the pair of sheet folding rollers. A control mechanism detects the delivery of the sheet to the pair of sheet folding rollers and operates the operating mechanism for a predetermined period of time.

7 Claims, 4 Drawing Figures

SHEET FOLDING MACHINE

This application is a continuation of application Ser. No. 305,318, filed Sept. 24, 1981 now abandoned.

BACKGROUND OF THE INVENTION

This invention relates to a sheet folding machine.

In a sheet folding machine known in the art, as shown in FIG. 1, a knife b and a pair of sheet folding rollers c and c are disposed, respectively above and below a sheet conveying path a. A stopper d is provided along the sheet conveying direction of the sheet conveying path a. A sheet A conveyed along the conveying path a is positioned by abutting it against the stopper d with a sheet widthwise displacing mechanism (for displacing a sheet in its widthwise direction). Under this condition, the sheet A is temporarily folded in two with the knife b, and is then inserted into the nipping region c' of the sheet folding rollers c, whereby the sheet A is completely folded in two. The sheet A abuts against the stopper d by the sheet widthwise displacing mechanism so that a sheet is folded in two at the same position at all times.

The above-described arrangement of the prior art sheet folding mechanism requires independent sheet conveying, widthwise displacing and folding operations, and therefore folding sheets takes a relatively long period of time, i.e., the work efficiency is relatively low.

Also, since the provision of the sheet widthwise displacing mechanism is necessary, the conventional sheet folding machine suffers from high manufacturing cost.

SUMMARY OF THE INVENTION

In view of the foregoing, an object of this invention is to provide a sheet manufacturing machine in which a sheet widthwise displacing operation and a sheet folding operation are carried out successively to eliminate the loss of time.

Another object of this invention is the elimination of the sheet widthwise displacing mechanism to simplify the construction and to reduce the manufacturing cost as much.

This invention will be described more fully in the description of the preferred embodiment when taken with the accompanying drawings.

BRIEF DESCRIPTION OF THE DRAWINGS

FIG. 2 is a sectional view taken along line II—II in FIG. 3;

FIG. 3 is a sectional view taken along line III—III in FIG. 2; and

FIG. 4 is a circuit diagram showing an operating circuit for a solenoid.

DESCRIPTION OF THE PREFERRED EMBODIMENT

One preferred embodiment of this invention will be described with reference to FIGS. 2 through 4.

Figure 1:
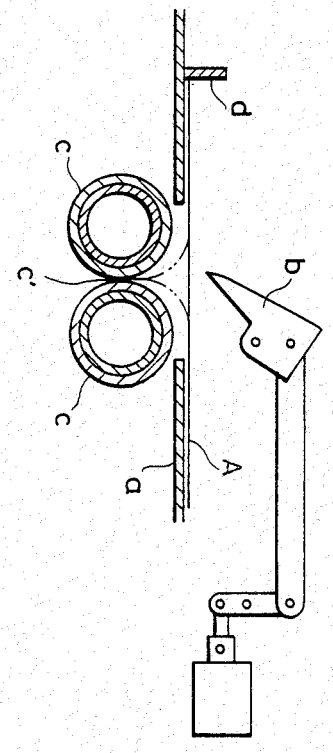
FIG. 1 PRIOR ART
FIG. 1 is an explanatory diagram showing a prior art sheet folding machine.
Figure 2:
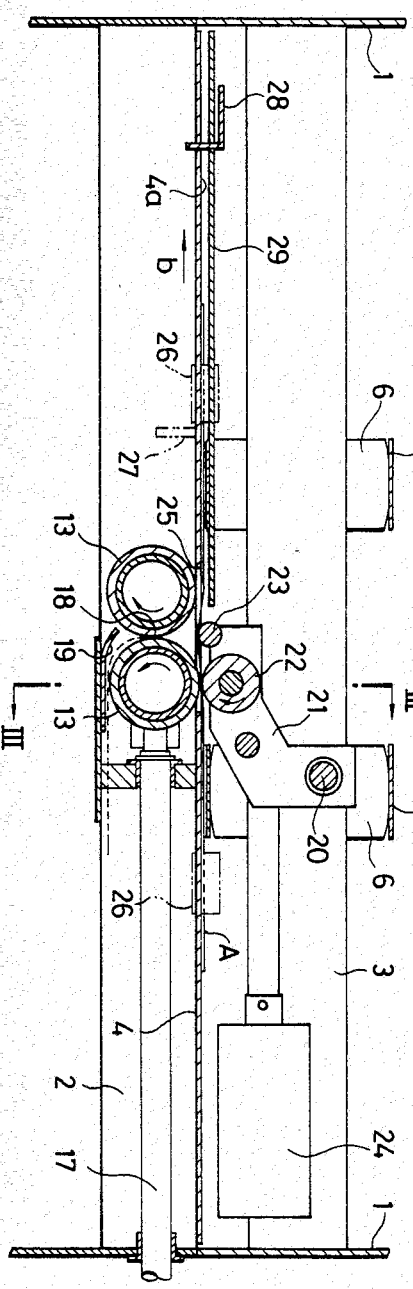
FIGS. 2, 3, and 4 show one embodiment of this invention, more specifically.
Figure 3:
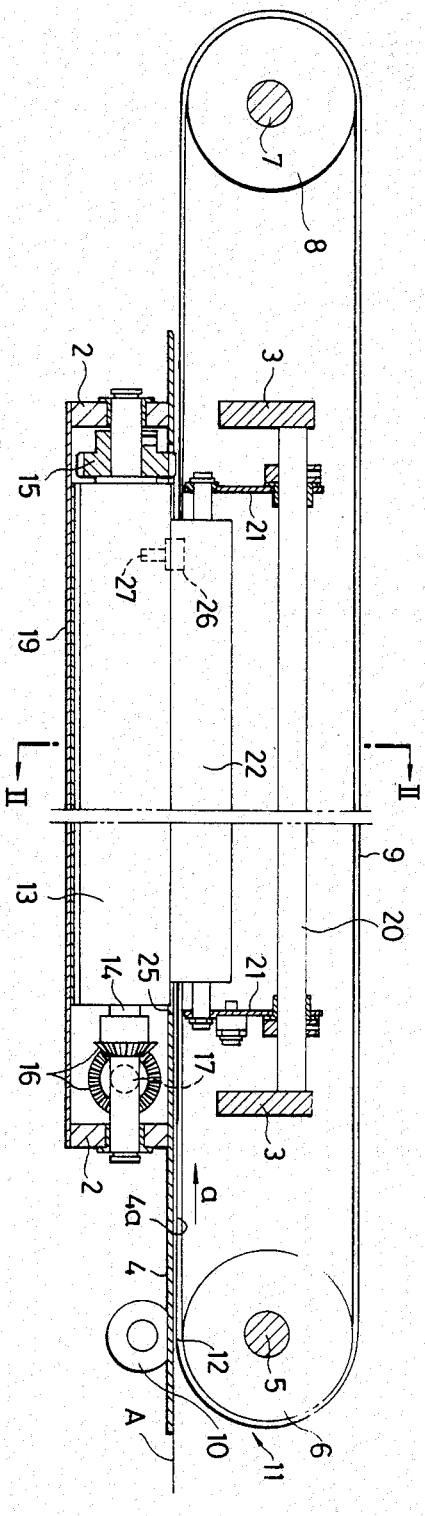

Referring to FIGS. 2 and 3, a pair of lower coupling members 2 and a pair of upper coupling members 3 extend fixedly between one pair of frames 1. A plate-shaped guide 4 is fixedly provided over the lower coupling members 2. A pair of driving roller 6 are mounted on a drive shaft 5 in the front part of the pair of frames 1, and a pair of driven rollers 8 are mounted on a support shaft 7 in the rear part of the pair of frames 1. Belts 9 are laid over the driving rollers 6 and the driven rollers 8, respectively. The belts 9 are driven in the direction of the arrow a along the upper surface 4*a* of the guide 4.

Idler rollers 10 abut against the driving rollers 6 through the belts 9, thus jointly forming conveying rollers 11, respectively. A sheet is inserted into the nipping regions 12 of the conveying rollers 11.

A pair of sheet folding rollers 13 are mounted on support shafts 14, respectively, between the lower coupling members 2 in such a manner that the rollers 13 abut against each other and are rotatable perpendicularly to the belts 9. The support shafts 14 are operated in association with each other through gears 15 (FIG. 3). One of the support shafts 14 is coupled through a bevel gear mechanism 16 to the drive shaft 17. A discharge guide plate 19 (FIG. 2) is provided below one of the sheet folding rollers 13. The discharge guide plate 19 is curved to confront the nipping region 18 of the rollers 13.

A support shaft 20 is fixedly provided crosswise between the pair of upper coupling members 3. A pair of L-shaped arms 21 are rotatably mounted on both end portions of the support shaft 20, respectively. An idle roller 22 and a sheet buckling shaft 23 are provided between the two arms 21. The arms 21 are turned upwardly or downwardly by a solenoid 24. More specifically, upon energization of the solenoid 24, the arms 21 are turned downwardly, so that the idle roller 22 and the sheet buckling shaft 23 are moved downwardly through an opening 25 cut in the guide plate 4. As a result, the idle roller 22 abuts against the sheet folding roller 13, while the sheet buckling shaft 23 confronts the nipping region 18.

In FIGS. 2 and 3, reference numeral 26 designates a conveying direction sheet stopper against which a conveyed sheet abuts. The stopper 26 is provided with a sensor 27 for detecting the front edge of a sheet.

In FIG. 2, reference numeral 28 designates a widthwise displacing direction sheet stopper against which a sheet abuts when displaced in a widthwise direction (or in the direction of the arrow b). A regulating plate 29 is provided between the stopper 28 and the opening 25 and along the upper surface 4*a* of the guide 4 in such a manner that it is spaced a predetermined distance from the upper surface 4*a* of the guide plate 4.

Figure 4:
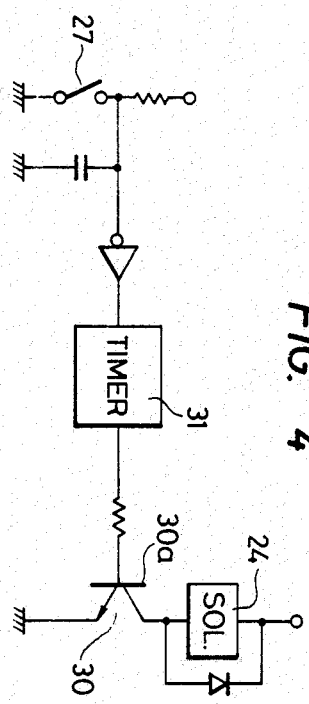

FIG. 4 shows an operating circuit for the solenoid 24. The solenoid 24 is connected through a switching transistor 30 to its power source. The base 30*a* of the switching transistor 30 is connected through a timer circuit 31 to the sensor 27.

The operation of the sheet folding machine according to the invention will now be described.

A sheet A is conveyed to the conveying rollers 11, where it is inserted into the nipping regions 12, and it is further conveyed in the direction of the arrow a along the guide 4 by the belts 9. When the front edge of the sheet A abuts against the conveying direction sheet stopper 26, the sensor 27 is actuated, and the switching transistor 30 is rendered conductive to energize the solenoid.

Upon energization of the solenoid, the arms 21 are swung downwardly about the support shaft 22 and as a result the sheet A is held between the idler roller 22 and one of the sheet folding rollers 13 (hereinafter referred to as (the first sheet folding roller 13) so that the sheet A is displaced in the widthwise displacing direction (or in the direction of the arrow b), while the sheet A is curved towards the nipping region 18 by the sheet buckling shaft 23.

When the sheet A, now displaced in the direction of the arrow b, abuts against the sheet stopper 28, the sheet is fed toward the nipping region 18 while being curved, i.e., substantially folded in two. Thus, with the crease of the sheet formed by this operation held by the nipping region 18, the sheet is moved downwardly by the rotating rollers 13. As a result, the sheet is completely folded in two and is discharged along the guide plate 19.

On the other hand, when a period of time set by the timer circuit 31 has passed, the solenoid 24 is deenergized so that the arms 21 are swung upwardly. As a result, the idle roller 22 moves from the first sheet folding roller 13, and consequently the sheet buckling shaft 23 is above the guide upper surface 4*a*. The period of time set by the timer circuit 31 is selected so that it lasts at least until the crease of the sheet is held by the nipping region 18.

As described above, in this invention, the sheet A is displaced in the widthwise displacing direction by the first sheet folding roller 13 and the idler roller 23, and in succession, the sheet A is folded in two by the pair of sheet folding rollers 13. That is, the sheet widthwise-displacing step and the sheet folding step are carried out in succession, which contributes to a reduction of the time required for the sheet folding operation, i.e., an improvement of the work efficiency.

Furthermore, according to the invention, the sheet is displaced in the widthwise direction by the first sheet folding roller 13 and the idler roller 22, and therefore the provision in prior art devices requiring a sheet widthwise displacing mechanism is dispensed with. This results in a sheet folding machine simple in construction and low in manufacturing cost.

When the sheet is folded in two, the part of the sheet on the side of the widthwise displacing direction sheet stopper 28 is regulated by the regulating plate 29 so that it may not be moved upwardly. Thus, the sheet can be smoothly folded in two.

As is apparent from the above description, in this invention, after being displaced in the widthwise direction by the first sheet folding direction 13 and the idle roller 22, the sheet is folded in two by the pair of sheet folding rollers 13 in succession. That is, the sheet widthwise-displacing operation and the sheet folding operation are carried out successively, which lead to an improvement of the work efficiency.

It is apparent that modifications of this invention can be made without departing from the essential novelty of the invention.

What is claimed is:

1. A sheet folding machine comprising:

a pair of sheet folding rollers positioned along a sheet conveying path and having their respective axes of rotation in a direction parallel to a sheet conveying direction in said sheet conveying path said sheet folding rollers having a nipping region therebetween to grasp and direct a portion of a sheet in a direction generally perpendicularly to a plane of said sheet conveying path;

a sheet stopper provided along the sheet conveying path for limiting widthwise displacement of said sheet within said plane of the sheet conveying path;

an idler roller having an axis of rotation parallel to said sheet conveying direction and positioned to depress a sheet against one of said sheet folding rollers to effectuate widthwise displacement of said sheet within said plane and in a direction perpendicular to said sheet conveying direction to abut said sheet against said sheet stopper;

means for bending a sheet into said nipping region;

means for selectively moving said idler roller and said means for bending into an operative position relative to said pair of sheet folding rollers at nipping region; and control means for detecting the delivery of said sheet to said pair of folding rollers and operating said means for selectively moving said idler roller and said means for bending to fold said sheet by nipping action of said sheet folding rollers.

2. The sheet folding machine of claim 1, wherein said control means comprises a sensor mounted on said sheet stopper to determine when a sheet is abutting said sheet stopper, said sensor actuating said control means.

3. The sheet folding machine of claims 1 or 2, wherein said control means comprises timer means to actuate said means for selectively moving wherein said idle roller and said means for bending are placed in an operative position for a predetermined time.

4. The sheet folding machine of claim 3, wherein said control means further comprises power switch means responsive to said timer means and said means for selectively moving comprises a solenoid actuated by said power switch means to move said idler roller and said means for bending into and out of an operative position relative to said sheet.

5. The sheet folding machine of claim 1, wherein said pair of sheet folding rollers abut against each other and said machine further comprising means to drive said pair of sheet folding rollers in opposite directions toward said nipping region wherein when said idler roller is in an operative position said sheet is displaced in a direction perpendicular to said sheet conveying direction by rotation of one of said sheet folding rollers.

6. The sheet folding machine of claims 1 or 5, further comprising a movable arm mounting said idle roller and said means for bending wherein said idle roller is positioned above said one of said sheet folding rollers and said means for bending is positioned in said nipping region when said movable arm is placed in an operative position at said nipping region.

7. The sheet folding machine of claim 6, further comprising an output guide positioned beneath said pair of sheet folding rollers to receive and discharge a folded sheet.

* * * * *